US005971891A

United States Patent [19]

Humphrey

[11] Patent Number: 5,971,891

[45] Date of Patent: Oct. 26, 1999

[54] ROLLER SKATING PRACTICE AND EXERCISE APPARATUS

[76] Inventor: Richard H. Humphrey, 606 Head St., San Francisco, Calif. 94132

[21] Appl. No.: 08/681,925

[22] Filed: Jul. 29, 1996

[51] Int. Cl.[6] ..... A63B 21/08

[52] U.S. Cl. ..... 482/51; 482/71; 482/54

[58] Field of Search ..... 482/74, 117, 118, 482/123, 51, 111, 52; 48/128, 62, 139, 23, 27, 33, 54, 72, 74, 136

[56] References Cited

U.S. PATENT DOCUMENTS

| | | | |
|---|---|---|---|
| 1,019,861 | 3/1912 | Titus | 482/123 |
| 1,535,391 | 4/1925 | Anderson | 482/117 |
| 4,114,873 | 9/1978 | Jones . | |
| 4,779,862 | 10/1988 | Keppler . | |
| 4,781,372 | 11/1988 | McCormack . | |
| 4,915,373 | 4/1990 | Walker . | |
| 4,940,226 | 7/1990 | Carra . | |
| 5,013,034 | 5/1991 | March et al. | 482/117 |
| 5,244,444 | 9/1993 | Wostry | 482/97 |
| 5,284,460 | 2/1994 | Miller et al. . | |
| 5,328,427 | 7/1994 | Sleamaker . | |
| 5,346,451 | 9/1994 | Miller . | |
| 5,429,563 | 7/1995 | Engel et al. . | |
| 5,451,194 | 9/1995 | Harrigan . | |

*Primary Examiner*—Jerome Donnelly

*Attorney, Agent, or Firm*—James J. Leary; Carol D. Titus

[57] ABSTRACT

A roller skating practice and exercise apparatus for combined upper body and lower body exercise has a skating platform with an upper surface for supporting a user wearing a pair of roller skates or in-line skates. The skating platform is foldable for easier portability and storage of the apparatus. Two extensible telescoping arm exercising poles are pivotally attached to the skating platform. The telescoping poles are constructed to provide axial resistance and rotational resistance to pivotal motion in all directions. An elastic tension member inside the hollow telescoping poles provides resistance to axial motion when the arm exercising poles are extended. The resistance to axial motion varies directly with the amount of displacement of the pole from its contracted position. The rotational resistance is provided by ball-and-socket joints which join the lower ends of the telescoping poles to the skating platform. The geometry of the ball-and-socket joints provides pivotal motion with rotational resistance in all directions. The ball-and-socket joints are adjustable to provide varying degrees of rotational resistance. The telescoping poles are removable for easier portability and storage of the apparatus. The full range of lower body movement in combination with the axial and rotational resistance of the telescoping poles allows a varied and complete workout for practicing the skills needed for roller skating and roller dancing while simultaneously training for improved strength and endurance.

20 Claims, 6 Drawing Sheets

ROLLER SKATING PRACTICE AND EXERCISE APPARATUS

FIELD OF INVENTION

The present invention relates generally to exercise equipment and more specifically to an apparatus for practicing the skills and techniques of roller skating or roller dancing while also providing aerobic exercise and athletic training for muscle toning and building.

BACKGROUND OF THE INVENTION

In recent years there has been a resurgence in the popularity of roller skating as a sport and as a leisure activity. One reason for the renewed popularity of roller skating is the emergence in the marketplace of in-line roller skates which are made with all of their wheels aligned in a single line from the front to the back of the skate. A consequence of this has been a renewed interest in roller skating in general, including standard roller skates which have their wheels arranged in pairs side-by-side and in roller dancing which is an offshoot of roller skating. Roller dancing is a graceful and energetic sport which combines the gracefulness of ballroom dancing or a chorus line and the athleticism of roller skating. Roller dancing can be practiced as a leisure activity, as an exhibition performance, as a paid performance or as a competitive tournament sport. Roller dancing requires a great deal of skill and precision that comes from training and practice, as well as strength and endurance which come from athletic training.

The aspiring roller skater or roller dancing participant can exercise his or her skills and gain strength and endurance by actual skating practice on a regular basis, but this is not always convenient. Skating practice generally requires an indoor skating rink or a large outdoor area which is smoothly paved. Indoor skating rinks are not available in every community and, when available, they can be costly to use on a regular basis and scheduling may be difficult. Outdoor areas suitable for skating are highly variable in their surface quality and they are subject to seasonal changes and weather. Consequently, it would be convenient to have a means for practicing the skills needed for skating and roller dancing while simultaneously training for improved strength and endurance without the necessity of a large skating area.

Prior art exercise apparatus have addressed some of these needs, but none have provided a complete solution which simultaneously addresses the multiple needs of practice for skating skills and athletic training for strength and endurance in a limited space. A number of strength training devices have been contrived for strengthening the specific musdes used in roller skating or ice skating. U.S. Pat. No. 4,781,372 for an Ice-Skating Exercise Device describes a weight lifting machine with foot pedals that run in tracks which are placed at a diverging angle to roughly simulate the motion of skating while strengthening the quadriceps and related muscles. U.S. Pat. No. 4,915,373 for an Exercise Machine for Ice Skating describes a strength training machine with foot pedals that run in loop-shaped tracks for more closely simulating the motion of skating while strengthening the leg muscles. While these strength training devices strengthen the specific muscles used in skating, they do not provide aerobic exercise for endurance training and they do not provide practice for the techniques, skills, balance and coordination required for roller skating.

A number of endurance training devices have also been contrived for increasing endurance for competitive roller skating or ice skating. U.S. Pat. No. 5,429,563 for a Combination Exercise Apparatus describes a treadmill with foot skates that are selectively placed on the surface of the treadmill. The straight back-and-forth motion of the foot skates more closely simulates the motion of cross country skiing than roller skating or ice skating. U.S. Pat. No. 5,328,427 for a Skating/Skiing Simulator with Ergometric Input-Responsive Resistance uses a lateral motion for the foot pads which roughly simulates the movements of skating or skiing. Resistance is provided by an ergometric input-responsive resistance device. In addition, ski pole handles attached by cables to the resistance device can provide arm exercise. U.S. Pat. No. 5,284,460 for a Skate Training Exercise Apparatus and Method describes an endurance training device with foot pedals that move in an arcuate path for more closely simulating the motion of actual skating. Resistance is provided by an electromagnetic brake, by flywheel-fans or by weight stacks. These devices improve a skater's endurance through aerobic exercise and strengthen the specific muscles used in skating. However, they also do not provide practice for the techniques, skills, balance and coordination required for roller skating.

U.S. Pat. No. 4,779,862 for an Exercising Apparatus for Skaters and U.S. Pat. No. 5,429,563 for a Simulated Skating Exercising Apparatus exemplify a different approach to providing skating-specific exercises. Each of these devices includes a low friction plastic glide sheet with stops at each end. The user wearing heavy socks glides side to side across the sheet between the stops in a lateral motion. While this approach comes closest to simulating the push-and-glide motion of actual skating it does not simulate the full range of movements used in roller dancing or the feel and balance of wearing roller skates.

U.S. Pat. No. 5,451,194 for a Roller Skate Exercise Device allows a skater to exercise in a limited space while wearing actual roller skates or in-line skates. The device has a platform with a top surface to support a pair of roller skates. Resistance is provided by elastic cords which attach to the user with ankle straps or by nonelastic cords which are connected to tension reels. The resistance cords restrict the movement of the roller skates to a back-and-forth motion simulating cross country skiing. Holes are provided in the platform for ski poles to improve the user's balance. Although this device allows the user to develop some balance and coordination by exercising while wearing actual roller skates, the restricted movement of the skates prevents the user from experiencing the full range of movement used in roller skating or roller dancing and therefore does not provide optimal practice for skating skills.

None of the above mentioned patents provide a satisfactory means for practicing roller skating or roller dancing in a limited area in a way that develops technique, skills, balance and coordination while simultaneously improving strength, endurance and overall fitness. It is desirable, therefore, to provide an apparatus that would allow a user to exercise while wearing actual roller skates or in-line skates in order to develop the balance and coordination that are important to roller skating and roller dancing. Advantageously, the exercise apparatus may also provide means for assisting novice skaters with their balance until they are fully comfortable on roller skates. Such an apparatus should allow a full, unrestricted range of motion to the user in order to develop techniques and skills for roller skating or roller dancing. Accordingly, the apparatus should allow sufficient area for lateral and forward and backward movements on the roller skates without being overly expansive. The apparatus should allow skating-specific muscular training exercises for the leg muscles and, preferably, should also provide cross-training exercises for upper body strength and general fitness. The exercise apparatus should also facilitate aerobic exercise routines, including upper and lower body movements, for improving cardiovascular fitness and increasing endurance. At the same time, the exercise apparatus should perform all of these functions in a minimal amount of space so that the users can complete a full exercise routine in their own homes or wherever a small amount of space is available. Preferably, the exercise apparatus should also be lightweight, portable and easily stored.

SUMMARY OF THE INVENTION

In keeping with the foregoing discussion, the present invention takes the form of a roller skating practice and exercise apparatus that has a skating platform with an upper surface for supporting a pair of roller skates. The skating platform is sized to allow the user enough area for performing modified skating movements for developing the skills and techniques of roller skating or roller dancing, as well as a variety of exercise routines designed to improve the user's skill, balance and coordination and to provide aerobic conditioning. In a preferred embodiment of the invention, the skating platform is formed in two sections which are hinged together in the center for easier portability and storage of the apparatus.

The roller skating practice and exercise apparatus includes two telescoping arm exercising poles that are pivotally attached to the skating platform. The telescoping poles serve multiple purposes. For novice skaters who are just getting accustomed to standing and moving on roller skates, the telescoping poles serve to assist the user with balance. When the telescoping poles are in their shortest, fully contracted position, the user can lean on the poles to help his or her balance. Then, as the user becomes more accustomed to being on roller skates, he or she can start to add arm movements to the exercise routine while the telescoping poles, in a more extended position, serve as a minor assist for balance and to keep the user centered on the skating platform. When the user, is fully comfortable with standing and moving on the roller skates, the telescoping poles provide arm resistance for a wide variety of upper body and combined upper body and lower body exercises.

The telescoping poles are constructed to provide axial resistance as well as pivotal rotational resistance in all directions. An elastic tension member inside the hollow telescoping poles provides resistance to axial motion. The resistance to axial motion varies directly with the amount of displacement of the pole from its shortest, fully contracted position. The rotational resistance is provided by specially constructed ball-and-socket joints which join the lower ends of the telescoping poles to the skating platform. The geometry of the ball-and-socket joints provides pivotal motion with rotational resistance in all directions. The ball-and-socket joints are adjustable to provide varying degrees of rotational resistance. The telescoping poles are removable for easier portability and storage of the apparatus. The full range of lower body movement in combination with the axial and rotational resistance of the telescoping poles allows a varied and complete workout for practicing the skills needed for roller skating and roller dancing while simultaneously training for improved strength and endurance.

DETAILED DESCRIPTION OF THE INVENTION

Figure 1:
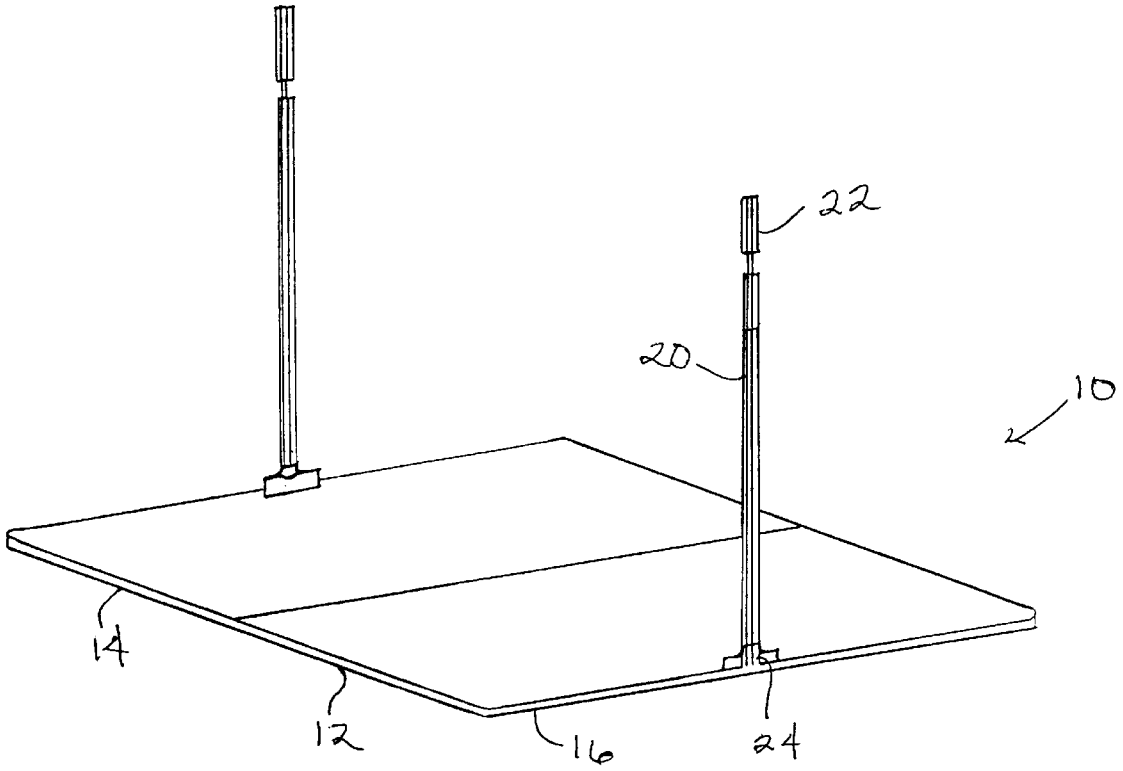
FIG. 1 is a perspective view of the roller skating practice and exercise apparatus of the present invention.

FIG. 1 is a perspective view of the roller skating practice and exercise apparatus 10 of the present invention. The roller skating practice and exercise apparatus 10 has a skating platform 12 that serves as a base for the apparatus. The skating platform 12 should be made of a hard, durable material that will readily support the weight of a person wearing roller skates or in-line skates. The top surface of the skating platform 12 should be a smooth surface that allows easy movement of the roller skates on the platform and it should be hard enough to avoid marring by the wheels of the roller skates. Suitable materials for the skating platform 12 include particle board, hardwood, particle board with a laminated top, plastic, metal, and other hard, durable materials. The skating platform 12 should be sized to allow the user a comfortable amount of room to workout by performing modified skating movements and other exercise routines without being too overly expansive. In current embodiments, the skating platform 12 is made with a surface with a width of approximately 32 inches and in three different lengths of 30, 36 and 42 inches. These sizes allow a sufficient amount of room for lateral and forward and backward movements on the roller skates, but are still small enough to allow the apparatus to be used in a person's home and to be easily transported or stored. The skating platform 12 may be made in a single section, or it may be formed in two or more sections 14,16 that are hinged or detachable from one another to allow the user to more easily transport and store the roller skating practice and exercise apparatus 10. Ideally, the skating platform 12 is made with two sections 14, 16 that are hinged together to allow the apparatus to be folded up for transport and storage.

The roller skating practice and exercise apparatus 10 includes two pivoting, telescoping arm exercising poles 20. One arm exercising pole 20 is attached to each side of the skating platform 12. The poles 20 have hand grips 22 at the top for a user to comfortably grip the pole 20. The bottom of the pole 20 is pivotally attached to the skating platform 12 by a ball-and-socket joint 24. The ball-and-socket joint 24 provides pivotal motion with rotational resistance in all directions. The arm exercising poles 20 are extensible by a telescoping action from a contracted position to an extended position, the fully extended length of the arm exercising poles 20 being slightly less than twice the contracted length. The optimal length for the poles 20 depends on the height of the user, however, 3 feet is considered a good standard length for the arm exercising poles 20 in the contracted position. There is an elastic tension member 50 which runs through the center of each pole 20 (see FIGS. 2 and 3) which provides axial resistance as the arm exercising poles 20 move from the contracted position to the extended position.

Figure 2:
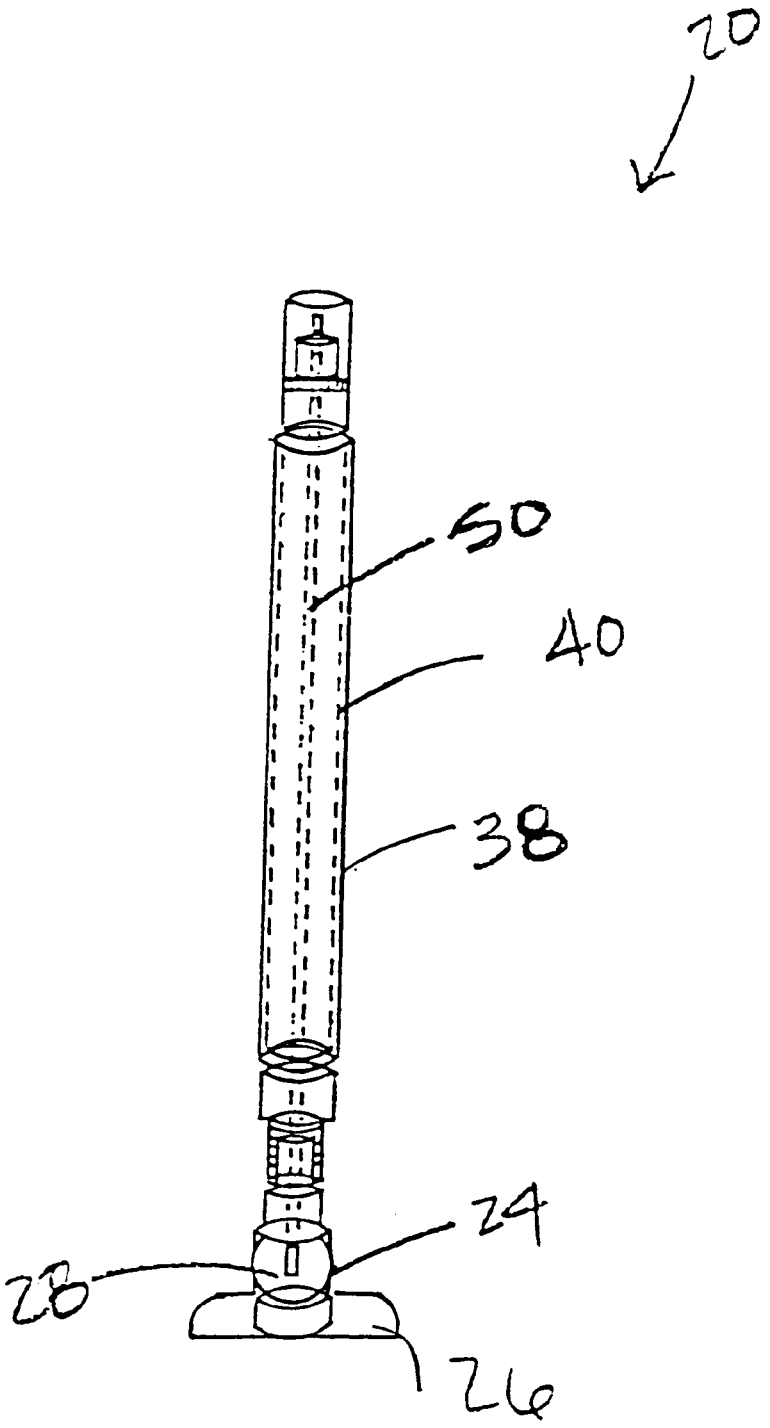
FIG. 2 is a side view of the telescoping arm exercising pole of the roller skating practice and exercise apparatus.
Figure 3:
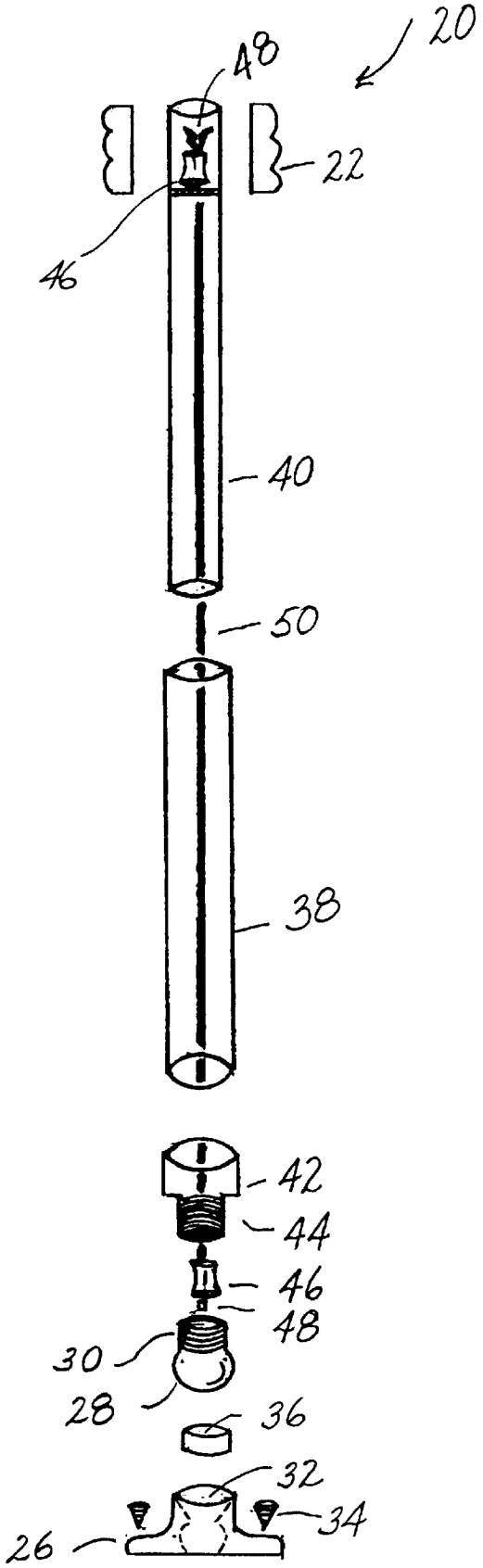
FIG. 3 is an exploded side view of the telescoping arm exercising pole of the roller skating practice and exercise apparatus.

FIG. 2 is a side view and FIG. 3 is an exploded side view showing the telescoping arm exercising pole 20 and the ball-and-socket joint 24 of the roller skating practice and exercise apparatus 10 in greater detail. At the bottom of the arm exercising pole 20 is a housing 26 which is attached by screws, adhesive or other attachment means 34 to the skating platform 12. Inside the housing 26 is a swivel ball 28 which fits into a socket 32 on the underside of the housing 26. The ball 28 engages a frictional surface 36. The frictional surface 36, which may be shaped like a disk, a cup or a ring, is inserted into the socket 32 below the ball 28. Alternatively, the frictional surface 36 may be made as part of the socket 32. The frictional surface 36 may be formed of any material which will frictionally engage the ball 28. In a preferred embodiment, the ball 28 and the housing 26 and the frictional surface 36, are made of metal. Alternatively, different materials may be used for the frictional surface 36 depending on the desired resistance, for example rubber, plastic or a metallic spring may be used. The rotational movement of the ball 28 against the frictional surface 36 generates a rotational resistance which opposes the pivotal motion of the arm exercising pole 20. The rotational resistance generated by the ball-and-socket joint 24 is relatively constant over the range of pivotal motion of the arm exercising pole 20. The rotational resistance of the ball-and-socket joint 24 is adjustable by tightening or loosening the attachment screws 34 which press the ball 28 against the frictional surface 36 to provide varying degrees of rotational resistance. The top of the swivel ball 28 has a section of threading 30 which engages a second section of threading 44 on a fitting 42. The fitting 42 is attached to the bottom of the first section 38 of the telescoping pole 20. This attachment can be formed with threading. Other methods of making this attachment are with adhesive, snap fitting, friction fit or any other desired means. The first section 38 of telescoping pole 20 encirdes or is encircled by a second section 40 of telescoping pole 20. The telescoping poles 20 are preferably made of a lightweight metal, such as aluminum. Additional sections of pole 20 may be added to accommodate different height users. At the top of the poles 20 are hand grips 22. Running through the hollow center of each of the poles 20 is an elastic tension member 50 which may be made from a bungee cord or similar elastic material. The two ends of the elastic tension member 50 are connected to two inserts 46 by a pair of clips 48 which are squeezed or crimped onto the ends of the elastic tension member 50. The two inserts 46 are respectively attach to the bottom of the first section 38 and to the top of the second section 40 of the telescoping pole 20 near the hand grip 22 by interference fit or other means. If desired these connections could be made at other locations. The only requirement is that the elastic member 50 must connect the sections 38,40 of the telescoping pole 20 together and provide resistance when the sections 38, 40 of the pole 20 are extended.

Each elastic tension member 50 provides increasing resistance as the elastic member 50 is stretched, thereby providing axial resistance as the arm exercising poles 20 move telescopically from the contracted position to the extended position. In one preferred embodiment of the invention a 30 inch bungee cord is used as the elastic tension member 50. This standard length elastic tension member 50 provides suitable axial resistance for a wide range of users because stronger users can use the apparatus 10 with the poles 20 in a more extended position to provide greater axial resistance while weaker users can use the poles 20 in a more contracted position for less resistance. If desired, the axial resistance of the telescoping poles 20, and therefore the intensity of the workout, can be changed by shortening or lengthening the elastic tension member 50, by adding supplementary elastic tension members or by substituting a stronger or weaker elastic tension member 50. The length of the arm exercising poles 20 and the length of the elastic tension member 50 can also be modified to accommodate individual users who are extremely short or extremely tall.

Figure 4:
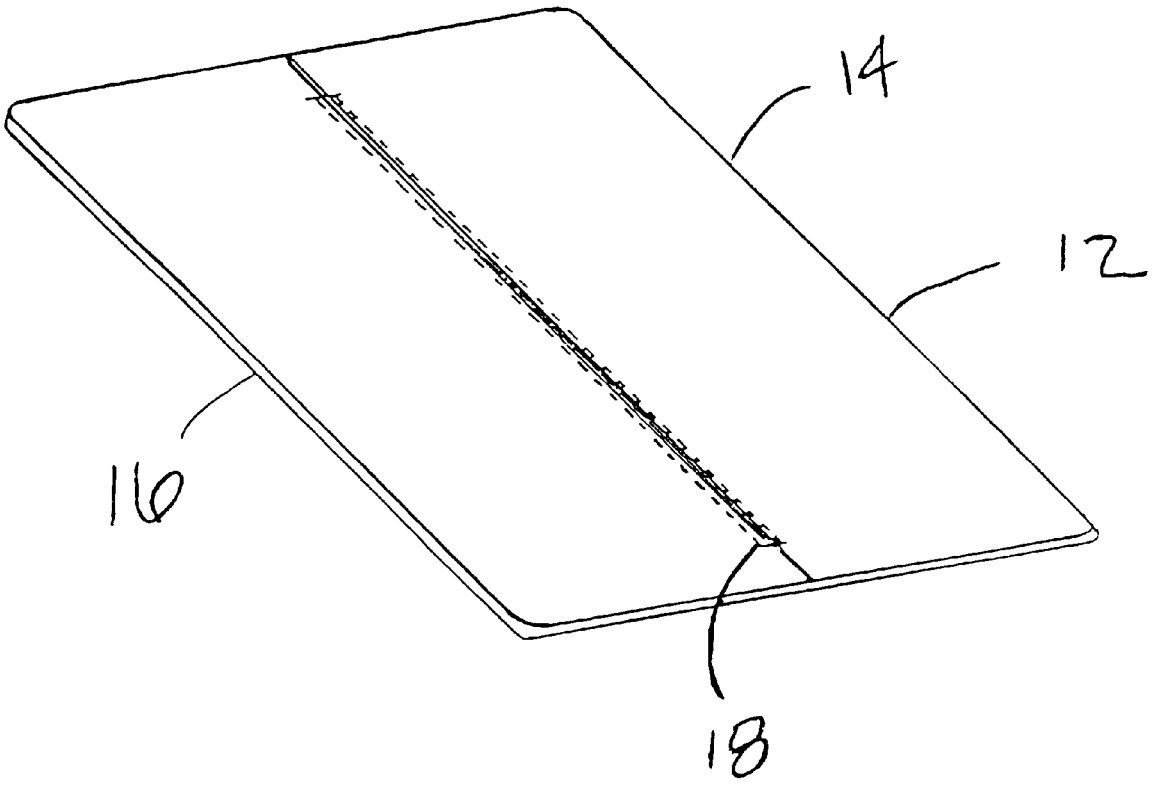
FIG. 4 is a bottom perspective view of the skating platform of the roller skating practice and exercise apparatus showing the hinge.
Figure 5:
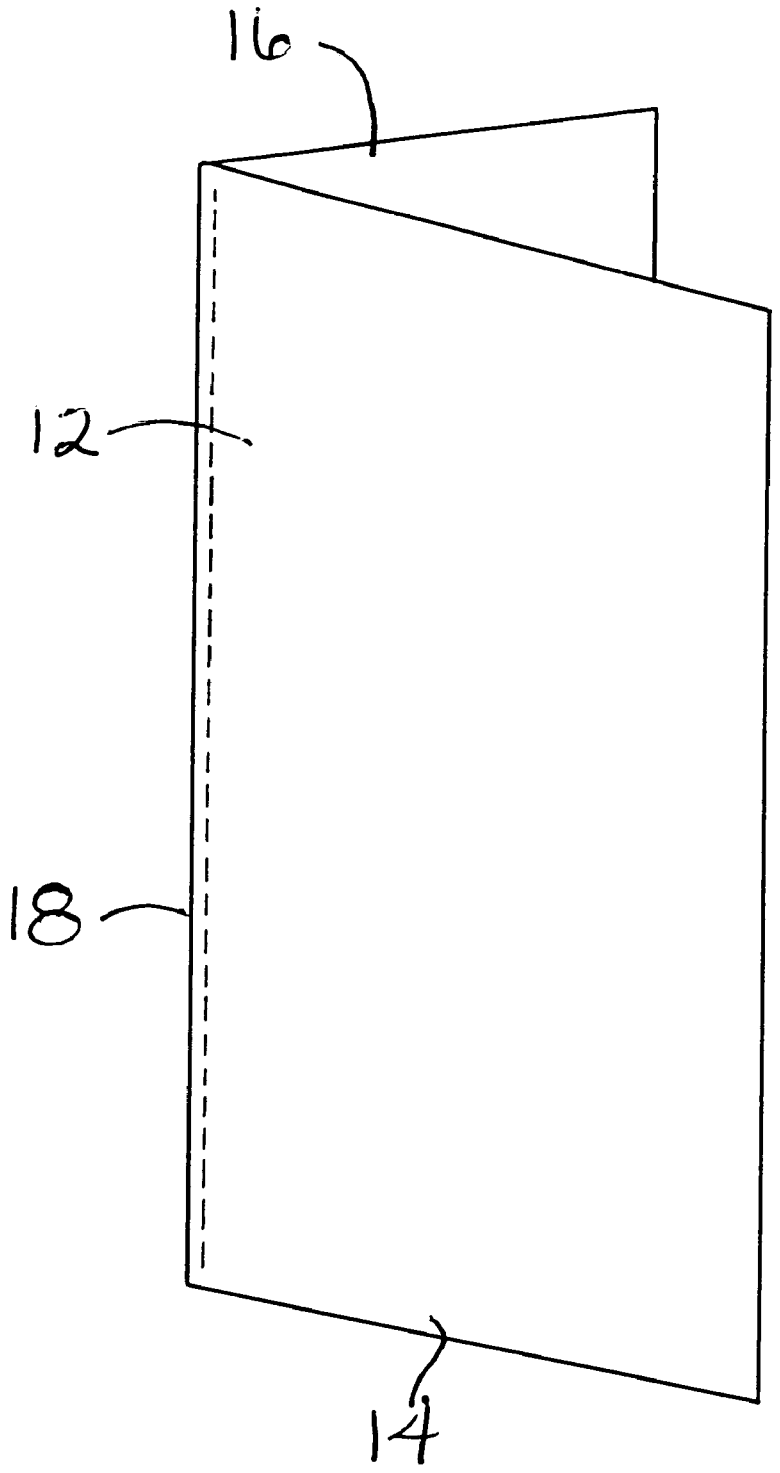
FIG. 5 is a perspective view of the skating platform of the roller skating practice and exercise apparatus partially folded.

FIG. 4 is a bottom perspective view of the skating platform 12 of a foldable embodiment of the roller skating practice and exercise apparatus 10. FIG. 5 is a perspective view of this embodiment with the skating platform 12 in a partially folded position. In this embodiment, the skating platform 12 is formed of two pieces 14,16 which are attached to one another along their facing edges by a hinge 18. The hinge 18 allows the skating platform 12 to be folded for easier portability and storage of the apparatus. The telescoping poles 20 are also removable by unscrewing the poles 20 from the ball-and-socket joints 24 to further improve the portability and ease of storage. The hinge 18 is placed on the bottom surface of the skating platform 12 so that it does not disturb the smooth upper surface of the skating platform 12. The two sections 14, 16 are carefully assembled to the hinge 18 so that when the skating platform 12 is unfolded and flattened out, there is no significant gap or step between the two sections 14, 16. This is especially important to assure that the user's roller skates or in-line skates do not trip or catch on any discontinuity between the two sections 14,16 during use. Preferably, the hinge 18 and the division between the two sections 14, 16 are oriented to run from the front to the back of the skating platform 12 so that they are parallel to the usual direction of the motion of the skates. The wheels of the skates will only cross over the division between the sections 14, 16 when the user is practicing lateral motions or crossover steps. During normal front-to-back or diagonal skating strides, the skate wheels will not cross over the division between the sections 14, 16 which will reduce the expected wear and tear on the skate wheels and decrease the likelihood of the user catching or tripping on any deviation between the sections 14, 16 of the skating platform 12.

Figure 6:
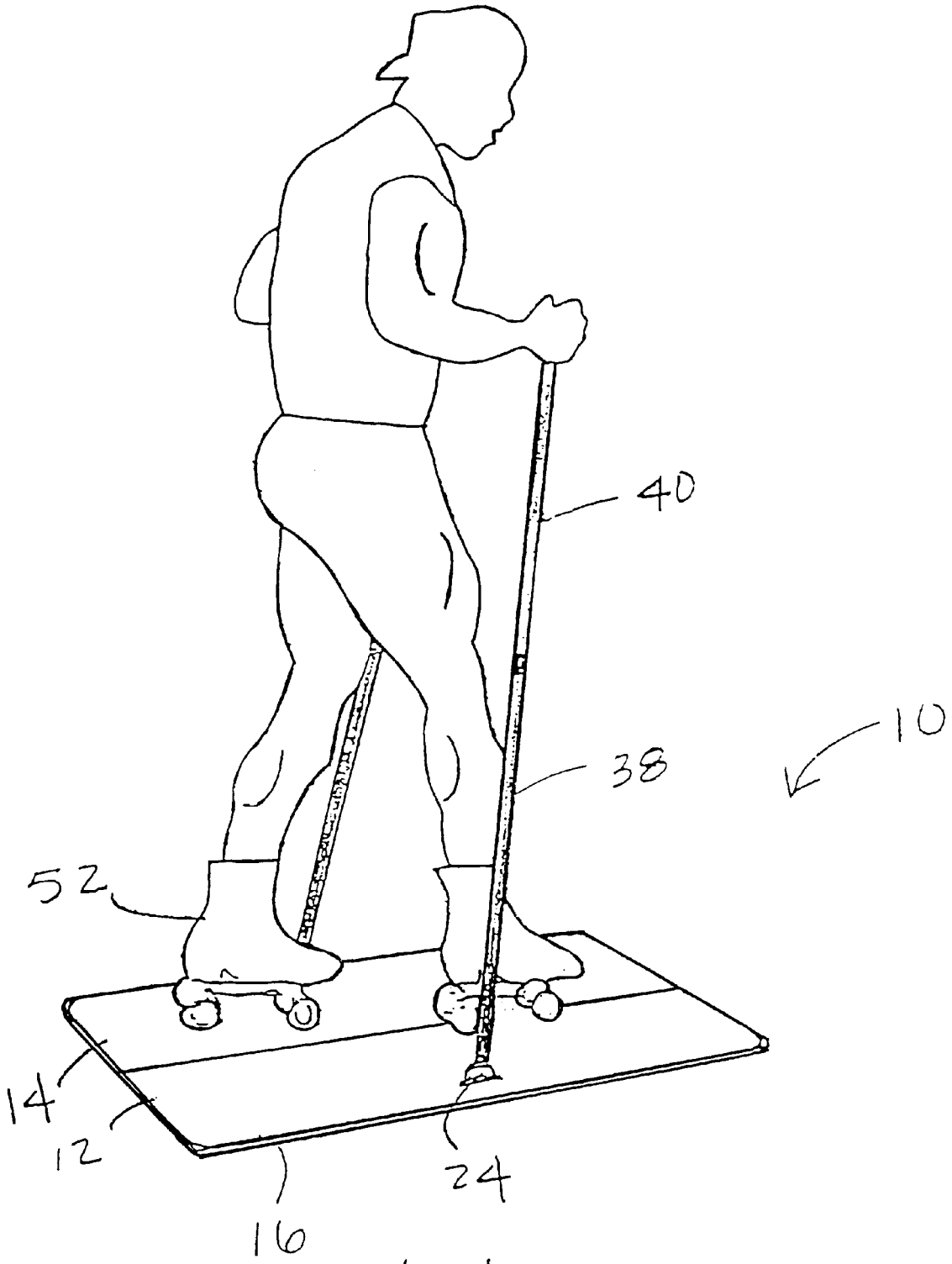
FIG. 6 is a perspective view of the roller skating practice and exercise apparatus in use.

FIG. 6 is a perspective view of the roller skating practice and exercise apparatus 10 of the present invention in use. A novice skater who is not yet accustomed to standing and moving on roller skates can simply stand on the skating platform 12 and oscillate the roller skates 52 back and forth while holding the telescoping arm exercising poles 20 for balance. This simple exercise will teach the skater balance and get him or her accustomed to the feel of the roller skates. Intermediate skaters can add arm movements and dancing steps to their practice routine and the telescoping arm exercising poles 20 will add resistance to increase the exercise value of the routine and serve as a minor assist for balance and to keep the skater centered on the skating platform 12.

Intermediate and advanced skaters can perform a variety of complete skillbuilding or aerobic exercise routines that combine upper body and lower body movements. Exercise routines on the roller skating practice and exercise apparatus 10 can be set to music to increase enjoyment and maintain the pace of the exercise routine. The two pivoting, telescoping arm exercising poles 20 provide axial resistance and rotational resistance that work the arms for upper body strength and conditioning. The omnidirectional rotation of the ball-and-socket joint 24 allows the user to perform arm exercises in all directions in a full 360 degree range of arm motion, including forward, backward, lateral and diagonal motions that work more muscle groups and provide more variety than a simple back-and-forth reciprocating motion. The leg motions can range from simple skating motions to complex roller dancing steps. The axial resistance of the telescoping arm exercising poles 20 can also be used to augment the resistance of the leg movements in many exercises. For example, lunging steps or squatting motions with one or both legs can be performed while holding the telescoping arm exercising poles 20 in an extended position to increase the resistance and to strengthen the quadriceps, the calf muscles, the gluteal muscles and other related muscles. These motions exercise the skating-specific muscles to increase strength and endurance.

There are a multiplicity of arm exercises which may be performed with the roller skating practice and exercise apparatus 10 separately or in combination with the leg exercises. Novice skaters who are still unsteady on their skates or others who wish to separately increase their upper body strength can remove their skates prior to performing an intensive arm workout. Some examples of different arm exercises follow. Biceps Curls: The user grasps the hand grip 22 like gripping a ski pole and bends the arm at the elbow, curling the forearm upwards to work the biceps muscles. Triceps Extensions: The user moves slightly forward on the skating platform 12 and rotates the pole 20 slightly backward. Then with the arm bent, the user grasps the hand grip 22 with the thumb towards the base of the pole 20. The exercise is then performed by extending the arm out towards the back to work the triceps muscles. Other exercises can be performed which exercise the deltoids, the trapezius and other muscle groups of the upper body. The combination of strength building leg exercises and arm exercises and a full range of lower body movement allows a varied and complete workout for practicing the skills and techniques of roller skating and roller dancing while simultaneously training for improved strength, endurance and general fitness.

Although the examples given include many specificities, they are intended as illustrative of only one possible embodiment of the invention. Other embodiments and modifications will, no doubt, occur to those skilled in the art. Thus, the examples given should only be interpreted as illustrations of some of the preferred embodiments of the invention, and the full scope of the invention should be determined by the appended claims and their legal equivalents.

I claim:

1. A roller skating exercise apparatus comprising:

a base having a top surface adapted to support a user wearing a pair of roller skates, at least one extensible arm exercising pole pivotally attached to said base, means for generating axial resistance to axial movement of said extensible arm exercising pole, and means for generating rotational resistance to pivotal movement of said extensible arm exercising pole, and wherein said means for generating axial resistance generates axial resistance in response to extension of said extensible arm exercising pole.

2. The roller skating exercise apparatus of claim 1 wherein said at least one extensible arm exercising pole comprises a pair of extensible arm exercising poles pivotally attached at opposite sides of said base.

3. The roller skating exercise apparatus of claim 1 wherein said means for generating axial resistance generates an axial resistance which is proportional to displacement of said extensible arm exercising pole from a contracted position toward an extended position.

4. A roller skating exercise apparatus comprising:

a base having a top surface adapted to support a user wearing a pair of roller skates, at least one extensible arm exercising pole pivotally attached to said base, means for generating axial resistance to axial movement of said extensible arm exercising pole, and means for generating rotational resistance to pivotal movement of said extensible arm exercising pole, and wherein said means for generating axial resistance comprises a tensile member which biases said extensible arm exercising pole toward a contracted position.

5. The roller skating exercise apparatus of claim 1 wherein said extensible arm exercising pole comprises a first pole section and a second pole section which move in telescoping relation from a contracted position to an extended position.

6. The roller skating exercise apparatus of claim 1 wherein said means for generating rotational resistance generates a rotational resistance which opposes pivotal motion of said extensible arm exercising pole in all directions.

7. The roller skating exercise apparatus of claim 6 wherein said rotational resistance is substantially constant over the range of pivotal motion of said extensible arm exercising pole.

8. The roller skating exercise apparatus of claim 6 wherein said rotational resistance is adjustable.

9. The roller skating exercise apparatus of claim 1 wherein said means for generating rotational resistance comprises a ball-and-socket joint which pivotally attaches said extensible arm exercising pole to said base.

10. The roller skating exercise apparatus of claim 9 wherein the rotational resistance generated by said ball-and-socket joint is adjustable.

11. The roller skating exercise apparatus of claim 1 wherein said base is made in at least two sections which are hingedly attached to one another.

12. The roller skating exercise apparatus of claim 1 wherein said extensible arm exercising pole comprises a first pole section and a second pole section which move in telescoping relation from a contracted position to an extended position, and said means for generating axial resistance comprises a tensile member connecting between said first pole section and said second pole section which biases said extensible arm exercising pole toward said contracted position, and said means for generating rotational resistance comprises a ball-and-socket joint which pivotally attaches said extensible arm exercising pole to said base.

13. An improved exercise apparatus of the type for performing a combination of upper body exercises and lower body exercises, wherein the improvement comprises:

at least one extensible arm exercising pole pivotally attached to said exercise apparatus, means for generating axial resistance to axial movement of said extensible arm exercising pole, and means for generating rotational resistance to pivotal movement of said extensible arm exercising pole, and wherein said means for generating axial resistance generates axial resistance in response to extension of said extensible arm exercising pole.

14. The improved exercise apparatus of claim 13 wherein said means for generating axial resistance comprises a tensile member which biases said extensible arm exercising pole toward a contracted position.

15. The improved exercise apparatus of claim 13 wherein said means for generating rotational resistance generates a substantially constant rotational resistance which opposes pivotal motion of said extensible arm exercising pole in all directions.

16. The improved exercise apparatus of claim 13 wherein said means for generating rotational resistance comprises a ball-and-socket joint which pivotally attaches said extensible arm exercising pole to said base.

17. The improved exercise apparatus of claim 13 wherein said means for generating axial resistance generates an axial resistance which is proportional to displacement of said extensible arm exercising pole from a contracted position toward an extended position.

18. The roller skating exercise apparatus of claim 4 wherein said extensible arm exercising pole comprises a first pole section and a second pole section which move in telescoping relation from a contracted position to an extended position.

19. The roller skating exercise apparatus of claim 4 wherein said base is made in at least two section which are hingedly attached to one another.

20. The roller skating exercise apparatus of claim 4 wherein said means for generating rotational resistance comprises a ball-and-socket joint which pivotally attaches said extensible arm exercising pole to said base.

* * * * *